US006115919A

United States Patent [19]

Oswald et al.

[11] Patent Number: 6,115,919

[45] Date of Patent: Sep. 12, 2000

[54] HEAT EXCHANGER

[75] Inventors: James I. Oswald; David A. Dawson, both of Burbage, United Kingdom

[73] Assignee: Rolls-Royce plc, London, United Kingdom

[21] Appl. No.: 09/055,898

[22] Filed: Apr. 7, 1998

Related U.S. Application Data

[62] Division of application No. 08/677,301, Jul. 9, 1996, Pat. No. 5,797,449.

[30] Foreign Application Priority Data

Jul. 12, 1995 [GB] United Kingdom ..... 9514236
Jul. 12, 1995 [GB] United Kingdom ..... 9514237

[51] Int. Cl.[7] ..... B23P 15/26

[52] U.S. Cl. ..... 29/890.039; 29/890.034

[58] Field of Search ..... 29/890.03, 890.034, 29/890.039; 165/165, 166, 167, 170

[56] References Cited

U.S. PATENT DOCUMENTS 3,787,944 1/1974 Mittman ..... 29/890.034
4,013,117 3/1977 Kopetzki et al. ..... 29/890.034
4,014,968 3/1977 Simon ..... 29/890.034
4,838,067 6/1989 Cornelison ..... 29/890.034
4,903,757 2/1990 Berendt ..... 29/890.034

FOREIGN PATENT DOCUMENTS 1328941 5/1973 United Kingdom .
2147095 5/1985 United Kingdom .

*Primary Examiner*—I. Cuda
*Attorney, Agent, or Firm*—W. Warren Taltavull; Farkas & Manelli PLLC

[57] ABSTRACT

An annular heat exchanger suitable for a gas turbine engine includes a first continuous sheet of material arranged in a spiral and a second continuous sheet of material arranged in a spiral. A first axially extending passage is defined between the first surface of the first sheet and the third surface of the second sheet and a second axially extending passage is defined between the second surface of the first sheet and the fourth surface of the second sheet. The first passage is closed at its axial ends by spiral seals between the first sheet and the second sheet. The second passage is open at its axial ends. A plurality of radially extending passages are provided to supply a first fluid at a first end into the first passage, to remove the first fluid from a second end of the first passage and to interconnect adjacent turns of the first passage. The passages extend radially through the second passage.

14 Claims, 8 Drawing Sheets

HEAT EXCHANGER

This is a Divisional of National Appln. No. 08/677,301 filed Jul. 9, 1996, now U.S. Pat. No. 5,797,449.

FIELD OF THE INVENTION

The present invention relates to heat exchangers and in particular to plate fin heat exchangers, or primary surface plate heat exchangers.

BACKGROUND OF THE INVENTION

Plate fin type heat exchangers generally comprise a plurality of plates, and a plurality of fins extend between and are secured to each adjacent pair of plates. The fins are secured to the plates by brazing, welding, diffusion bonding etc. The fins are defined by corrugated plates. In plate fin type heat exchangers the fins define passages for the flow of fluids to be put into heat exchange relationship.

Primary surface plate type heat exchangers generally comprise a plurality of plates, and a plurality of spacers extend between each adjacent pair of plates to separate the plates. In primary surface plate type heat exchangers the plates define passages for the flow of fluids to be put into heat exchange relationship.

A plate fin heat exchanger or primary surface plate heat exchanger is capable of being closely positioned around an engine, such as a gas turbine engine, if the heat exchanger is in a spiral form. These spiral heat exchangers will provide advantages of being cheaper to manufacture, produce lower thermal stresses and provide blade containment if positioned around a turbine of a gas turbine engine. However previous attempts to manufacture a spiral heat exchanger did not result in a simple practical method for supplying the fluids to and removing the fluids from the heat exchanger.

SUMMARY OF THE INVENTION

The present invention seeks to provide a novel heat exchanger and a novel method of manufacturing a heat exchanger.

Accordingly the present invention provides a method of manufacturing an annular heat exchanger comprising the steps of (a) forming a first continuous sheet of material having a first surface and a second surface, (b) forming a second continuous sheet of material having a third surface and a fourth surface, (c) forming a first set of apertures in the first continuous sheet of material, forming a second set of apertures in the first continuous sheet of material, adjacent apertures in the first set of apertures being spaced apart longitudinally of the first continuous sheet of material, adjacent apertures in the second set of apertures being spaced apart longitudinally of the first continuous sheet of material, the first and second set of apertures being spaced apart transversely of the first continuous sheet of material, (d) forming a third set of apertures in the second continuous sheet of material, forming a fourth set of apertures in the second continuous sheet of material, adjacent apertures in the third set of apertures being spaced apart longitudinally of the second continuous sheet of material, adjacent apertures in the fourth set of apertures being spaced apart longitudinally of the second continuous sheet of material, the third and fourth set of apertures being spaced apart transversely of the second continuous sheet of material, (e) winding the first and second continuous sheets of material together into a spiral such that the apertures of the first set of apertures in the first continuous sheet of material are aligned with the apertures in the third set of apertures in the second continuous sheet of material and the apertures of the second set of apertures in the first continuous sheet of material are aligned with the apertures of the fourth set of apertures in the second continuous sheet of material, (f) sealing the edges of the first surface of the first continuous sheet of material to the edges of the third surface of the second continuous sheet of material, (g) sealing the apertures of the first set of apertures in the first continuous sheet of material to the apertures in the third set of apertures in the second continuous sheet of material and sealing the apertures of the second set of apertures in the first continuous sheet of material to the apertures of the fourth set of apertures in the second continuous sheet of material, such that a second surface of the first continuous sheet of material is sealed to a fourth surface of the second continuous sheet of material.

The method may include forming at least one continuous corrugated sheet of material, winding the at least one continuous corrugated sheet of material together with the first and second continuous sheets of material.

The method may include forming two continuous corrugated sheets of material, positioning one of the continuous corrugated sheets of material between the first and second continuous sheets of material and winding the continuous corrugated sheets of material together with the first and second continuous sheets of material.

Preferably the sealing of the edges is by brazing, welding or crimping. Preferably the sealing of the edges is by continuously welding in spiral paths.

Preferably the sealing of the edges is by welding.

The present invention also provides an annular heat exchanger comprising a first continuous sheet of material and a second continuous sheet of material, the first continuous sheet of material is arranged in a spiral, the second continuous sheet of material is arranged in a spiral, the first continuous sheet of material has a first surface and a second surface, the second continuous sheet of material has a third surface and a fourth surface, a first axially extending passage is defined between the first surface of the first continuous sheet of material and the third surface of the second continuous sheet of material, a second axially extending passage is defined between the second surface of the first continuous sheet of material and the fourth surface of the second continuous sheet of material, the ends of the first axially extending passage are sealed at the edges of the first and second continuous sheets of material, the ends of the second axially extending passage are open, at least one radially extending passage extending through the first or the second continuous sheet of material to supply a first fluid into the first axially extending passage, at least one radially extending passage extending radially through the first or second surface of the second continuous sheet of material to remove a first fluid from the first axially extending passage, the at least one radially extending passage arranged to supply first fluid into the first axially extending passage and the at least one radially extending passage arranged to remove first fluid from the first axially extending passage are spaced apart transversely of the first and second continuous sheets of material.

The heat exchanger may include at least one continuous corrugated sheet of material, the continuous corrugated sheet of material is arranged in a spiral. The at least one continuous corrugated sheet of material may be positioned between the first surface of the first continuous sheet of material and the third surface of the second continuous sheet of material. The at least one continuous corrugated sheet of material may be positioned between the second surface of the first continuous sheet of material and the fourth surface of the second continuous sheet of material.

Preferably there are a plurality of radially extending passages to supply first fluid to the first passage.

Preferably there are a plurality of radially extending passages to remove first fluid from the first passage.

Preferably there are a plurality of radial passages extending through the second axially extending passage to supply first fluid between adjacent turns of the spiral.

Preferably there are a plurality of radial passages extending through the second axially extending passage to supply first fluid between adjacent turns of the spiral.

BRIEF DESCRIPTION OF THE DRAWINGS

The present invention will be more fully described by way of example with reference to the accompanying drawings, in which.

DETAILED DESCRIPTION OF THE INVENTION

Figure 1:
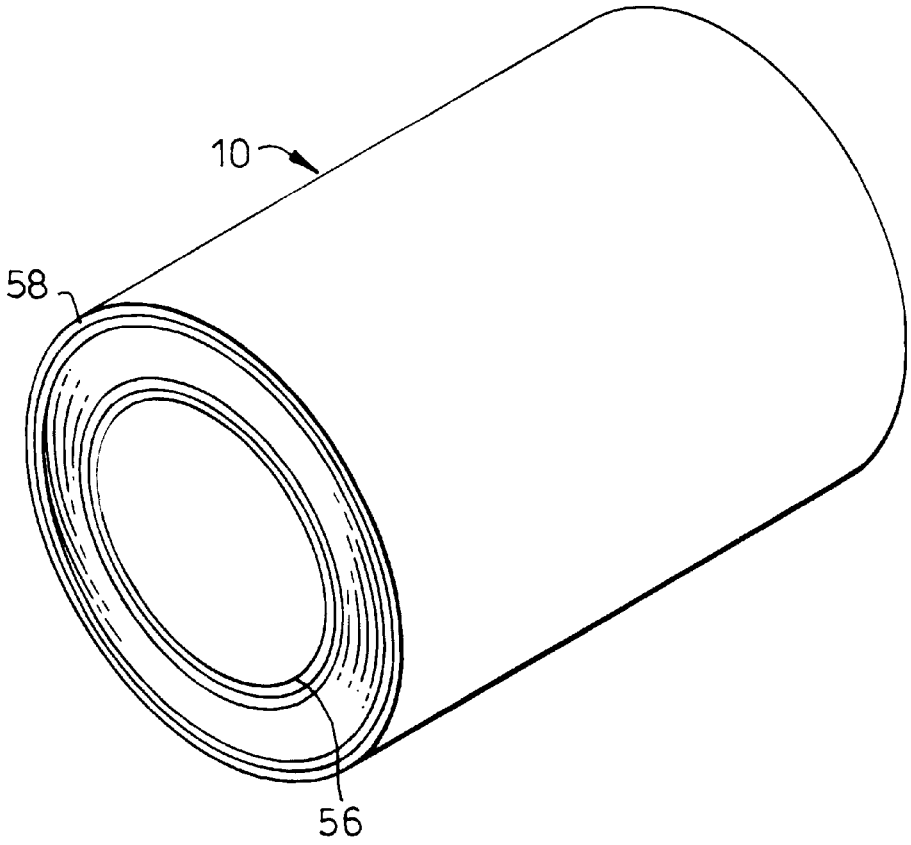
FIG. 1 is a view of a heat exchanger according to the present invention.
Figure 3:
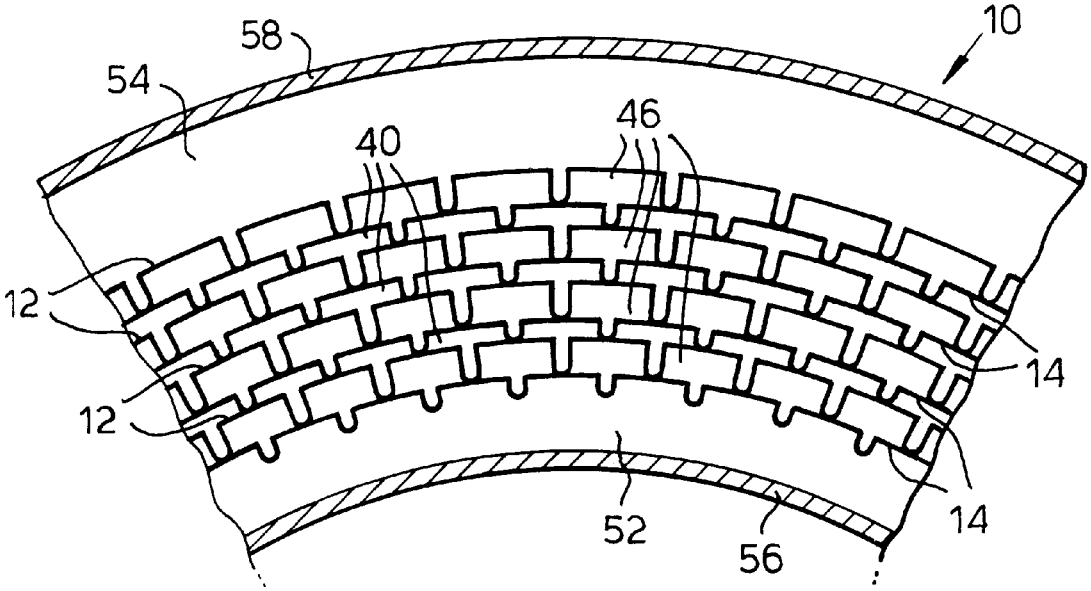
FIG. 3 is a cross-sectional view along lines A—A in FIG. 2.
Figure 2:
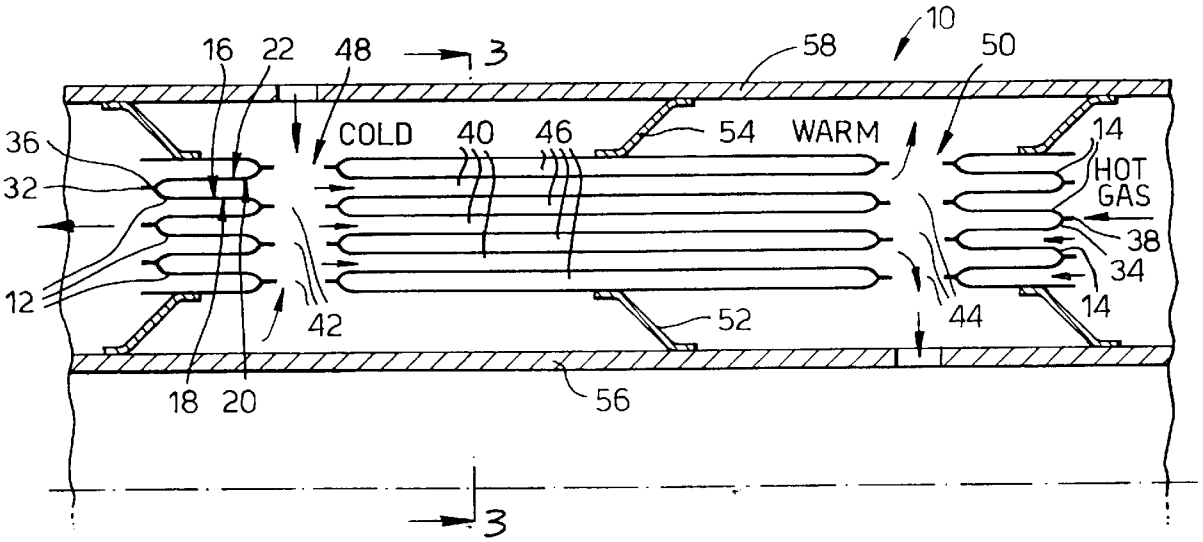
FIG. 2 is an enlarged longitudinal cross-sectional view through the heat exchanger shown in FIG. 1.

A heat exchanger 10 suitable for a gas turbine engine intercooler, regenerator, or recuperator is shown in FIGS. 1, 2 and 3. The heat exchanger 10 is annular and comprises a first continuous sheet of material 12 and a second continuous sheet of material 14. The first and second sheets of material 12 and 14 are arranged in a spiral.

The first continuous sheet of material 12 has a first surface 16 and a second surface 18 and similarly the second continuous sheet of material 14 has a third surface 20 and a fourth surface 22. The first and second continuous sheets of material 12 and 14 are arranged such that the first surface 16 of the first continuous sheet of material 12 faces the third surface 20 of the second continuous sheet of material 14 and the second surface 18 of the first continuous sheet of material 12 faces the fourth surface 22 of the second continuous sheet of material 14.

The first continuous sheet of material 12 has a first set of apertures 24 spaced apart longitudinally of the first continuous sheet of material 12 and a second set of apertures 26 spaced apart longitudinally of the first continuous sheet of material 12. The apertures 24 and 26 are spaced transversely of the first continuous sheet of material 12. The apertures 24 are arranged at a predetermined distance from the longitudinally extending edge 32 of the first continuous sheet of material 12 and also the apertures 26 are arranged at a predetermined distance from the longitudinally extending edge 34 of the first continuous sheet of material 12.

The second continuous sheet of material 14 has a third set of apertures 28 spaced apart longitudinally of the second continuous sheet of material 14 and a fourth set of apertures 30 spaced apart longitudinally of the second continuous sheet of material 14. The apertures 28 and 30 are spaced transversely of the second continuous sheet of material 14. The apertures 28 are arranged at a predetermined distance from the longitudinally extending edge 36 of the second continuous sheet of material 14 and also the apertures 30 are arranged at a predetermined distance from the longitudinally extending edge 38 of the second continuous sheet of material 14.

The longitudinally extending edges 32 and 34 of the first continuous sheet of material 12 are sealed to the longitudinally extending edges 36 and 38 of the second continuous sheet of material 14 by brazing, welding, gluing or crimping etc by two continuous spiral seals. The sealing of the edges 32 and 34 of the first continuous sheet of material 12 to the edges 36 and 38 of the second continuous sheet of material 14 defines a single axially extending passage 40 between the first surface 16 of the first continuous sheet of material 12 and the third surface 20 of the second continuous sheet of material 14. The passage 40 does of course extend in a spiral.

The edges of the apertures 24 are sealed to the edges of the apertures 28 and the edges of the apertures 26 are sealed to the edges of the apertures 30 in such a manner as to provide passages 42 and 44 to interconnect the adjacent turns of the axially extending passage 40. The sealing of the edges of the apertures together as discussed also defines a single axially extending passage 46 between the second surface 18 of the first continuous sheet of material 12 and the fourth surface 22 of the second continuous sheet of material 14. The passage 46 does of course extend in a spiral. The passages 42 form a first manifold 48 for supplying a first fluid radially to the passage 40 and the passages 44 form a second manifold 50 for removing the first fluid from the passage 40. A second fluid is supplied through the passage 46.

Preferably the passages 42 between adjacent turns of the axially extending passage 40 are arranged such that their axes lie on lines radiating from the axis of the heat exchanger 10. Similarly the passages 44 between adjacent turns of the axially extending passage 40 are arranged such that their axes lie on lines radiating from the axis of the heat exchanger 10. Thus there are several, for example six, radial manifolds 48 and several, for example six, radial manifolds 50. These radially aligned passages 42 and 44 are shown more clearly in FIG. 9.

The first continuous sheet of material 12 has projections extending radially inwardly to space its second surface 18 from the fourth surface 22 of the second continuous sheet of material 14. Similarly the second continuous sheet of material 14 has projections extending radially inwardly to space its third surface 20 from the first surface 16 of the first continuous sheet of material. It is equally possible to have projections extending radially outwardly from both the first and second continuous sheets of material 12 and 14, or to have projections extending radially inwardly and radially outwardly from either the first continuous sheet of material 12 or from the second continuous sheet of material 14 to space the surfaces 16, 18 of the first continuous sheet of material 12 from the surfaces 20,22 of the second continuous sheet of material 14. However, it may be possible to dispense with the projections in some circumstances.

At the inner and outer surfaces of the heat exchanger 10 circumferentially extending dividing walls 52 and 54 are provided. The outer end of the wall 52 is sealed to the inner surface of the sheet of material 14 of the annular heat exchanger 10 at a position between the two sets of apertures adjacent the edges of the sheets of materials. Similarly the inner end of the wall 54 is secured to the outer surface of the sheet of material 12 of the annular heat exchanger 10 at a position between the two sets of apertures adjacent the edges of the sheets of materials. The other ends of the walls 52 and 54 are sealed to inner casing 56 and outer casing 58 respectively. The walls 52 and 54 separate the first fluid at its entry and exit points to the annular heat exchanger 10.

In the particular arrangement shown a relatively hot second fluid is supplied to the right hand side of the annular heat exchanger 10. The hot second fluid in this example is the hot exhaust gases from the gas turbine engine. A relatively cold first fluid is supplied to the first manifold 48. The cold fluid in this example is the air supplied from the compressor, before it is supplied to the combustion chamber (s) of the gas turbine engine. The second fluid passes axially through the passage 46 in counter flow to the flow of first fluid axially through the passage 40. The second fluid gives up heat to the first fluid as they pass through the passages 46 and 40 respectively of the annular heat exchanger 10. The first fluid leaving the second manifold 50 has been heated by heat exchange with the second fluid and the first fluid is then supplied to the combustion chamber(s) of the gas turbine engine.

Alternatively it would be possible to supply the relatively cold second fluid to the right hand side of the annular heat exchanger 10. The relatively hot first fluid is supplied to the first manifold 48. The second fluid passes axially through the passage 46 in counter flow to the flow of first fluid axially through the passage 40. The first fluid gives up heat to the second fluid as they pass through the passages 40 and 46 respectively of the annular heat exchanger 10. The second fluid leaving the passages 46 has been heated by heat exchange with the first fluid and the second fluid is then supplied to the combustion chamber(s) of the gas turbine engine.

Alternatively the fluids may be arranged to flow in the opposite directions while remaining within the scope of the present invention.

The first and second continuous sheets of material are preferably stainless steel, although other suitable metals, alloys, plastics or ceramics may be used.

Figure 4:
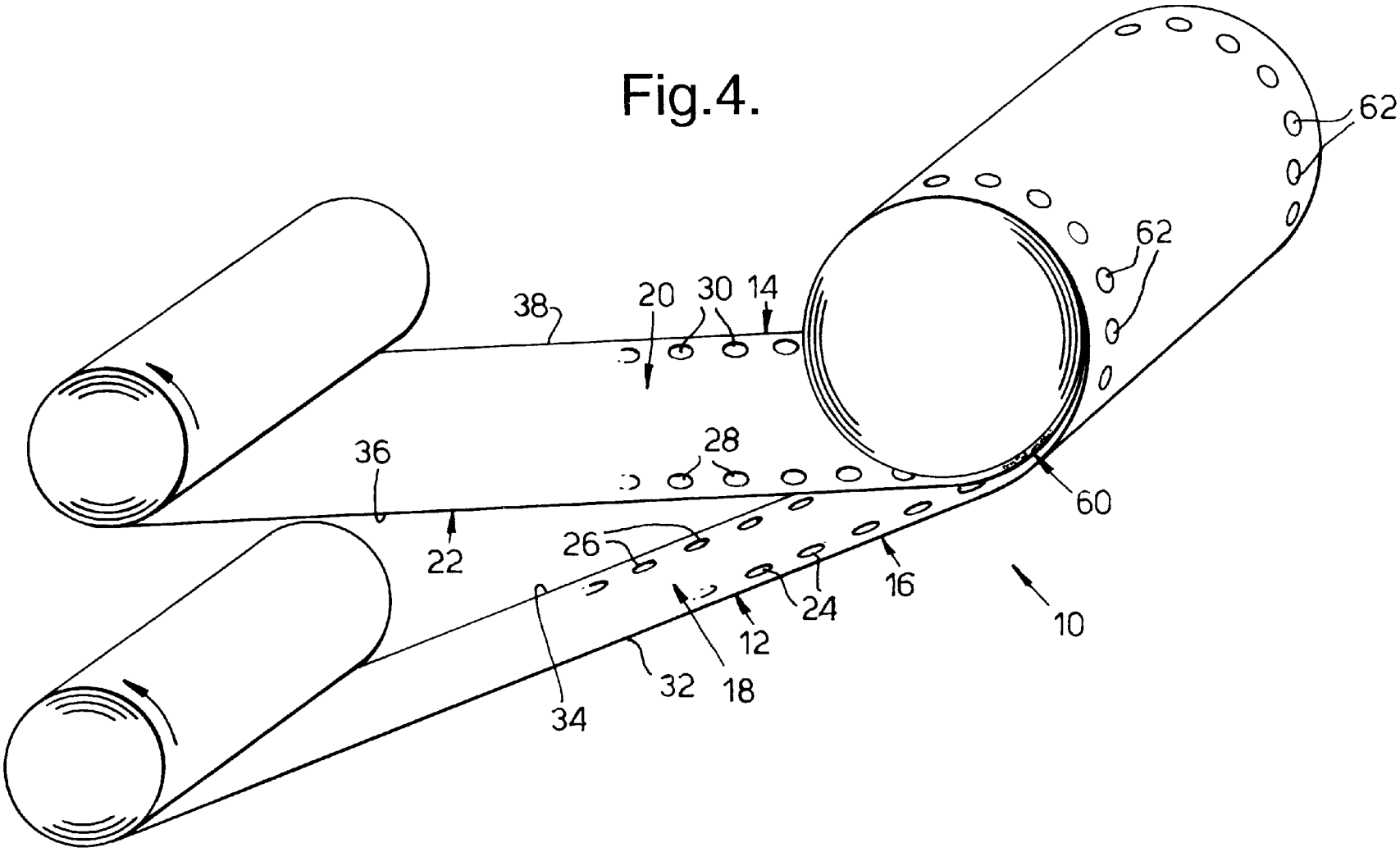
FIG. 4 is a perspective view of a method of manufacturing the heat exchanger shown in FIGS. 2 and 3.

The heat exchanger 10 is manufactured, as shown in FIG. 4, by firstly preparing two continuous sheets of material 12 and 14, for example stainless steel. A first set of apertures 24 and a second set of apertures 26 are formed in the first continuous sheet of material 12 at predetermined distances from the edges 32 and 34 of the first continuous sheet of material 12. Similarly a third set of apertures 28 and a fourth set of apertures 30 are formed in the second continuous sheet of material 14 at predetermined distances from the edges 36 and 38 of the second continuous sheet of material 14.

The apertures 24, 26, 28 and 30 are preferably punched out of the first and second continuous sheets of material 12 and 14, but other suitable techniques may be used.

The areas immediately around the apertures 24, 26, 28 and 30 are deformed towards the fourth and second surfaces 22 and 18 to form depressions to space the first and second continuous sheets of material 12 and 14 apart. Also the edges 32, 34, 36 and 38 of the first and second continuous sheets 12 and 14 are deformed towards the third and first surfaces 20 and 16.

The edges of the apertures 24 and 28 are sealed 62 together and the edges of the apertures 26 and 30 are sealed together to form interconnecting passages 42 and 44 between passage 40. The sealing of the apertures is preferably by welding. It is also possible to achieve the sealing by brazing, gluing or crimping or other suitable methods. It is preferred that the edges of the apertures 24 and 28 are sealed together before the first and second continuous sheets of material 12 and 14 are wound together in a spiral.

The first and second continuous sheets of material 12 and 14 are wound together into a spiral.

The first and second continuous sheets of material 12 and 14 are wound together sufficiently tightly and the longitudinal spacing between adjacent apertures in each of the four sets of apertures 24, 26, 28 and 30 is such that the axes of the apertures align to form the radial manifolds 48 and 50. The first and second continuous sheets of material 12 and 14 are preferably wound on a tubular or stepped tubular, mandrel.

The edges 32 and 34 of the first surface 16 of the first continuous sheet of material 12 are sealed to the edges 36 and 38 of the third surface 20 of the second continuous sheet of material 14. This is achieved by welding continuously in two spiral paths 60 while the first and second continuous sheets of material 12 and 14 are wound together. Alternatively the edges may be welded together after the continuous sheets of material have been wound together. As a further alternative it may be possible to place spirals of caulking material between the edges 32 and 34 of the first surface 16 and the edges 36 and 38 of the third surface 20 and weld the edges to the caulking strips.

When the first and second continuous sheets of material 12 and 14 are fully wound onto the heat exchanger 10 the longitudinal ends are sealed, for example by welding transversely, or axially, to prevent the leakage of hot gas or cold air from the passages 46 and 40 respectively and to join the adjacent turns of the spiral together. Additionally other transverse, or axial, welds may be provided at suitable positions spaced from the ends to join adjacent turns of the spiral together.

Figure 5:
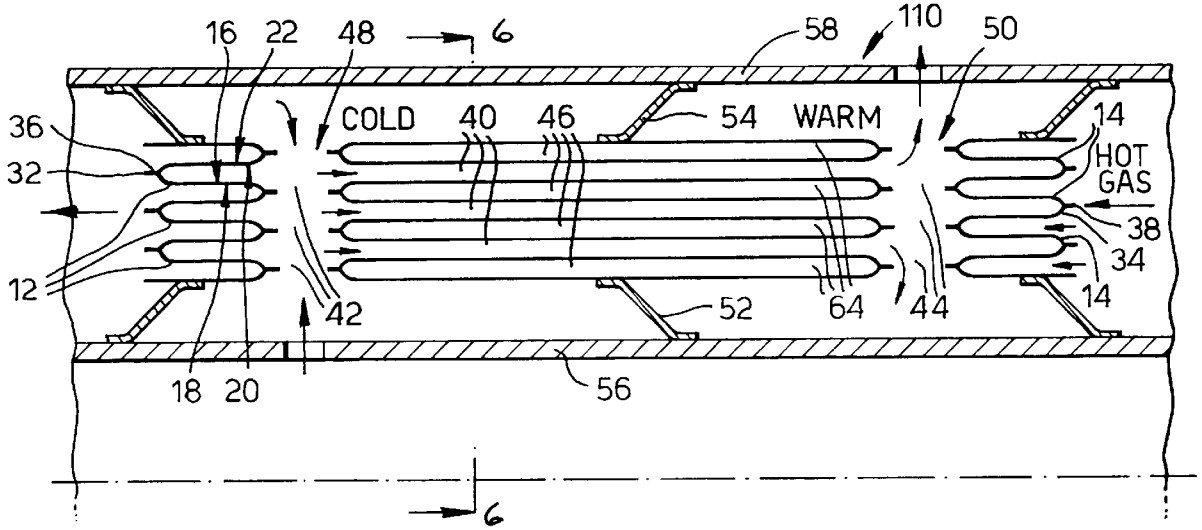
FIG. 5 is an enlarged longitudinal cross-sectional view through an alternative heat exchanger according to the present invention.
Figure 6:
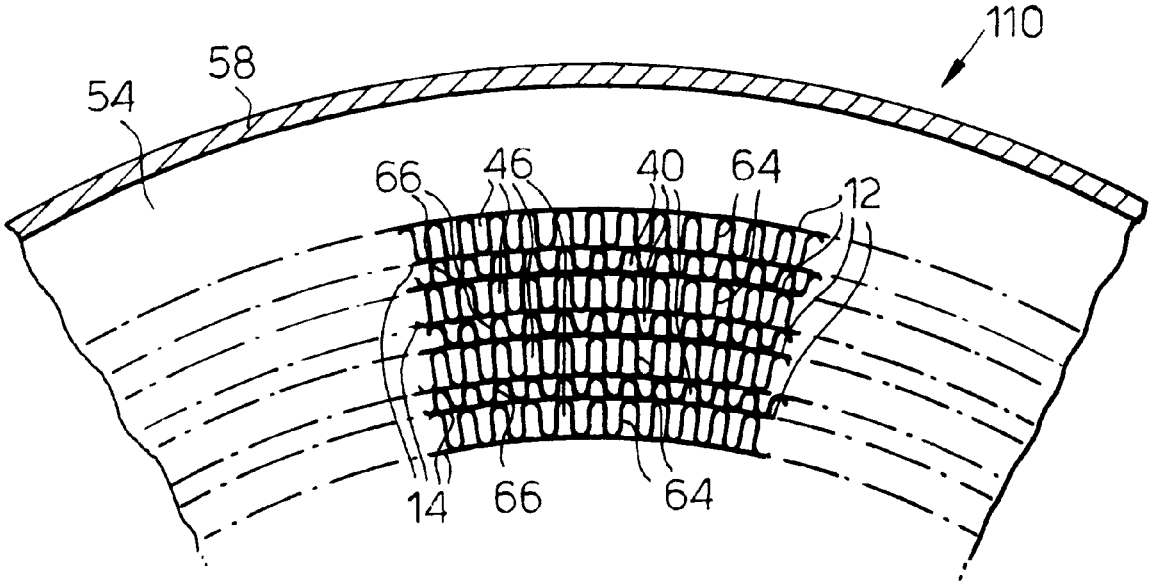
FIG. 6 is a cross-sectional view along line B—B in FIG. 5.

The invention described above is a primary surface plate heat exchanger, but the invention is equally applicable to a plate fin heat exchanger 110 as shown in FIGS. 5 and 6. In that case it is possible to have two continuous corrugated sheets of material 64 and 66 and the first and second continuous sheets of material 12 and 14 all arranged in spirals. One of the continuous corrugated sheets of material 64 is positioned between the first and second continuous sheets of material 12 and 14. The other one of the continuous corrugated sheets of material 66 abuts one of the other continuous sheets of material 14. The corrugations of the continuous corrugated sheets of material 64 and 66 are arranged to extend transversely, or axially, of the sheets of material 12 and 14.

The heat exchanger 110 is manufactured, by firstly preparing two continuous sheets of material 12 and 14, forming the four sets of apertures 24, 26, 28 and 30 in the first and second continuous sheets of material 12 and 14. The areas immediately around the apertures 24, 26, 28 and 30 are deformed to form depression and the edges 32, 34, 36 and 38 are deformed. The edges of the apertures 24 and 28 and the edges of the apertures 26 and 30 are sealed together.

Figure 7:
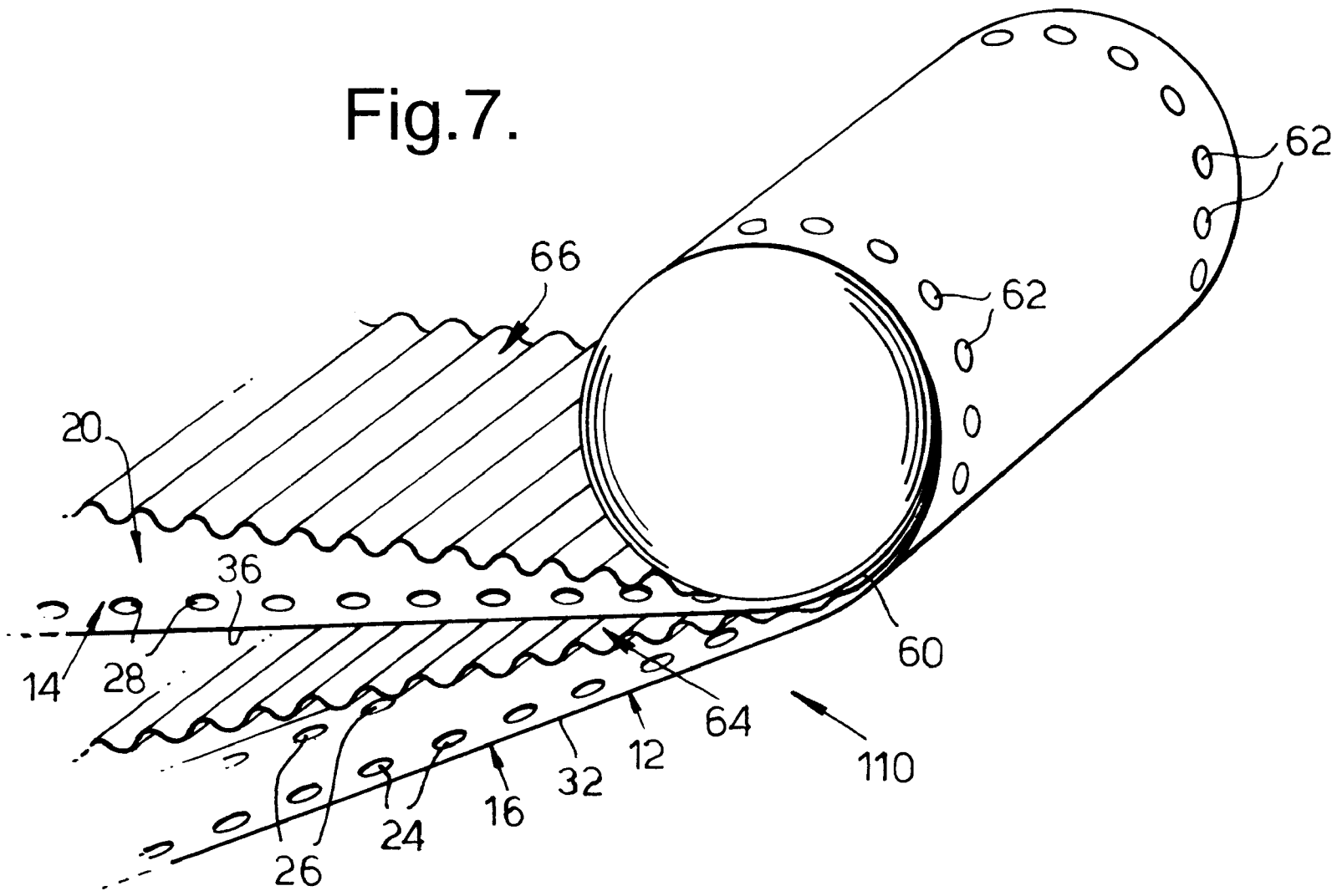
FIG. 7 is a perspective view of a method of manufacturing the heat exchanger shown in FIGS. 4, 5 and 6.

The corrugated sheet of material 64 is positioned between the first and second continuous sheets of material 12 and 14 and the fourth continuous corrugated sheet of material 66 is positioned abutting the first continuous sheet of material 12, as shown in FIG. 7.

The first and second continuous sheets of material 12 and 14 and the third and fourth continuous corrugated sheets of material 64 and 66 are wound together into a spiral, preferably around a tubular or stepped tubular mandrel.

The edges 32 and 34 of the first surface 16 of the first continuous sheet of material 12 are sealed to the edges 36 and 38 of the third surface 20 of the second continuous sheet of material 14, preferably by welding either while the sheets of material 12, 14 are being wound together or after the sheets of material 12, 14 have been wound together. Then the longitudinal ends of the first and second continuous sheets of material 12 and 14 are sealed by welding; transversely of the sheets or axially of the heat exchanger.

Figure 8:
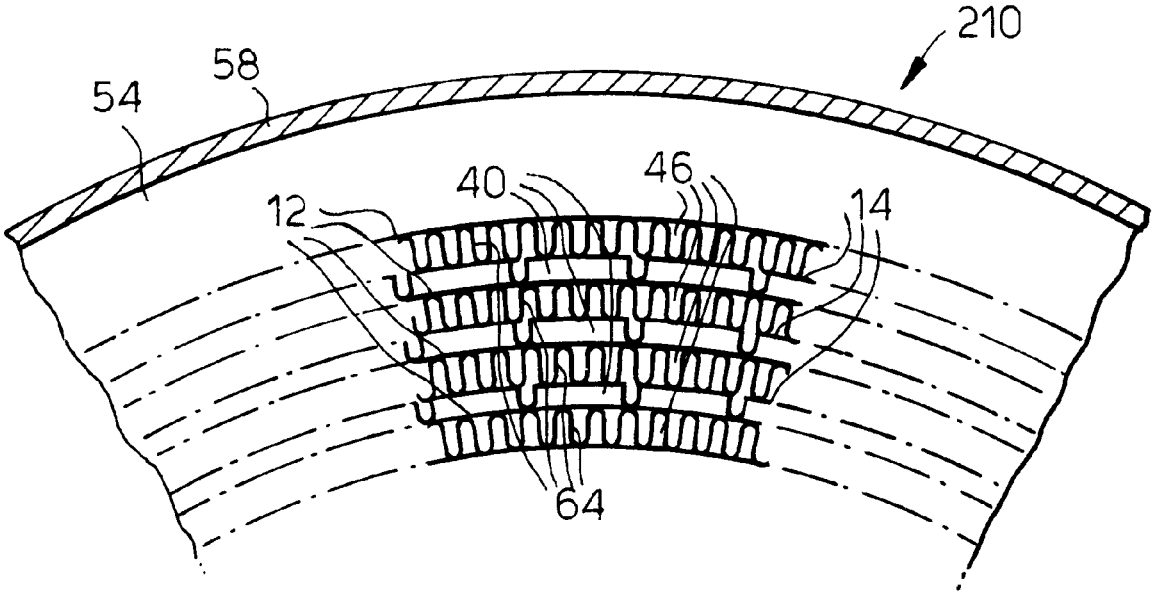
FIG. 8 is an alternative cross-sectional view along line B—B in FIG. 5.
Figure 9:
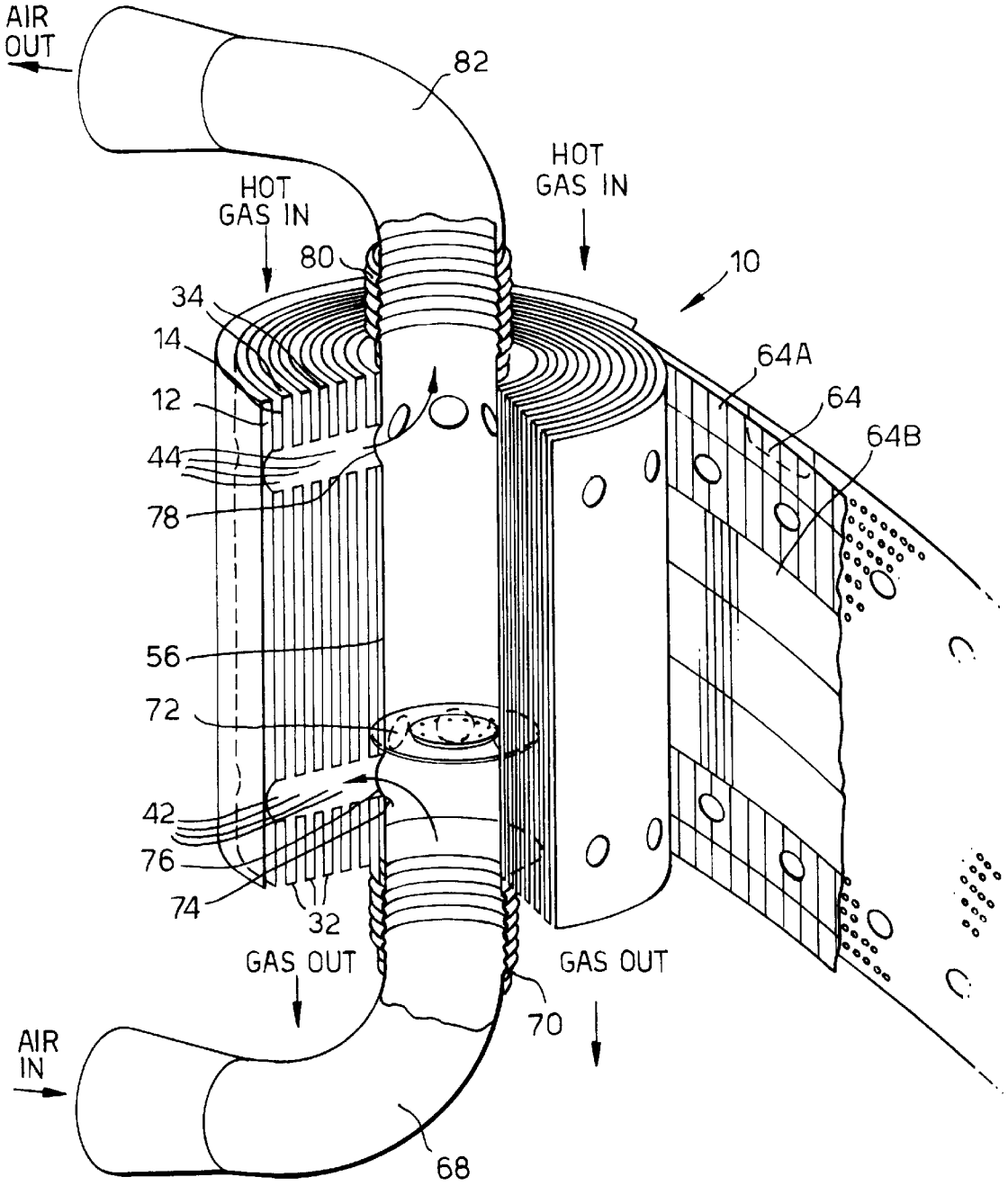
FIG. 9 is a partially cut-away perspective view of the heat exchanger shown in FIG. 8.

Furthermore the heat exchanger 210 may be part plate fin heat exchanger and part primary surface plate heat exchanger as shown in FIGS. 8 and 9. In that case it is possible to have one continuous corrugated sheet of material 64 and the first and second continuous sheets of material 12 and 14, all the sheets of material are arranged in spirals. The continuous corrugated sheet of material 64 is positioned either between the first and second continuous sheets of material 12 and 14 or abuts one of the other continuous sheets of material 12 or 14. The corrugations of the continuous corrugated sheet of material 64 are arranged to extend transversely, or axially, of the sheets of material 12, 14.

The heat exchanger 210 is manufactured by firstly preparing the two continuous sheets of material 12 and 14, forming the four sets of apertures 24, 26, 28 and 30 in the first and second continuous sheets of material 12 and 14. The areas immediately around the apertures 24, 26, 28 and 30 are deformed to form depressions and the edges 32, 34, 36 and 38 are deformed. The second continuous sheet of material 14 has radially inwardly extending projections.

The edges of the apertures 24 and 28 and the edges of the apertures 26 and 30 are sealed together.

The corrugated sheet of material 64 is positioned between the first and second continuous sheets of material 12 and 14.

The first and second continuous sheets of material 12 and 14 and the corrugated sheet of material 64 are wound together in a spiral, preferably around a tubular or stepped tubular mandrel.

The edges 32 and 34 of the first surface 16 of the first continuous sheet of material 12 are sealed to the edges 36 and 38 of the third surface 20 of the second continuous sheet of material 14, preferably by welding either while the sheets of material are being wound together or after the sheets of material have been wound together. Then the longitudinal ends of the first and second continuous sheets of material 12 and 14 are sealed by welding transversely of the sheets, or axially of the heat exchanger.

The heat exchanger in FIG. 9 has an air inlet pipe 68 for the heat exchanger, which is connected to the heat exchanger by a first bellows arrangement 70. The first bellows arrangement 70 is arranged coaxially with the axis of the heat exchanger to supply air to the radially inner side of the heat exchanger within the inner casing 56. The inner casing 56 is preferably the tubular mandrel which was used to manufacture the spiral heat exchanger. A blanking plate 72 is positioned within the inner casing 56 to prevent the flow of air axially straight through the inner casing 56. The air is caused to flow radially outwardly through a set of apertures 74 in the inner casing 56 and radially outwardly through the passages 42 before flowing axially through the heat exchanger and radially inwardly through the passages 44 and through a further set of apertures 78 in the inner casing 56. The inner casing 56 is provided with trumpet shape extensions 74 to the apertures 76 to provide a smooth flow of air into the passages 42. The air then flows axially out of the heat exchanger through a second bellows arrangement 80 into an air outlet pipe 82. The second bellows arrangement 80 is also arranged coaxially with the axis of the heat exchanger to remove air from the radially inner side of the heat exchanger within the inner casing 56.

The corrugated sheet of material 64 in FIG. 9 has zones 64A at its transverse edges, or axial edges, where the longitudinal spacing between the corrugations is of relatively large dimensions and it has a zone 64B at its centre where the longitudinal spacing between the corrugations is of relatively small dimensions. The relatively large spacing between the corrugations in the zones 64A is to enable the gas to flow around the radial passages 44 and 42 and to be distributed more evenly, circumferentially around the heat exchanger. However, it may be possible to have uniformly spaced corrugations over the full transverse, or axial, dimension of the heat exchanger.

The supply of fluid to, and removal of fluid from, the radial passages 42 and 44 may be radially inwardly, radially outwardly or a combination of the two. In FIG. 2, the fluid is supplied radially inwardly to passage 42 and is removed radially inwardly from passage 44. In FIG. 5, the fluid is supplied radially outwardly to passage 42 and is removed radially outwardly from passage 44. In FIG. 9 the fluid is supplied radially outwardly to passage 42 and is removed radially inwardly from passage 44. It would be equally possible to supply fluid radially inwardly to passage 42 and to remove the fluid radially outwardly from passage 44.

The advantages of this type of spiral heat exchanger compared to a flat heat exchanger is that the thermal stresses are significantly less in the spiral heat exchanger, about 10 times less, because the hottest end of the spiral heat exchanger can expand radially without restraint by the colder end of the heat exchanger.

Additionally the spiral heat exchanger is relatively cheap to manufacture because there are only a relatively few number of components, the first and second continuous strips of material and possibly one or two corrugated strips, and the manufacturing process is a continuous process. There is very little wastage of material, and the need for brazing of the corrugated sheets is eliminated.

The spiral heat exchanger has counter flows of fluid which is good for heat exchange, and there is a low pressure drop across the heat exchanger making it very efficient for gas to gas heat exchangers.

The heat exchanger may be tailored for the use of different fluids by selecting the appropriate corrugation size and projection size.

One or more of the spiral heat exchangers may be positioned in the exhaust of a gas turbine engine, depending on the size of the gas turbine engine and its associated exhaust duct. If any heat exchanger fails it may be replaced or disconnected.

Figure 10:
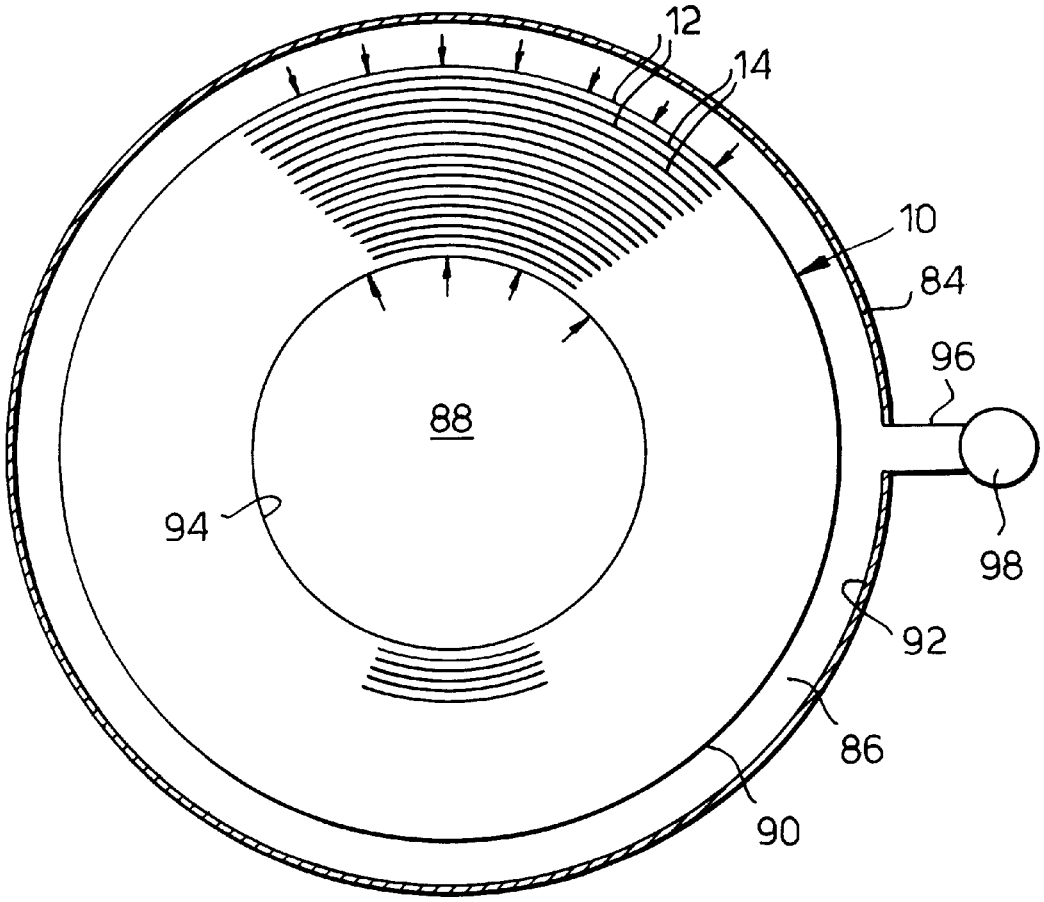
FIG. 10 is a cross-sectional view through a further heat exchanger according to the present invention.
Figure 11:
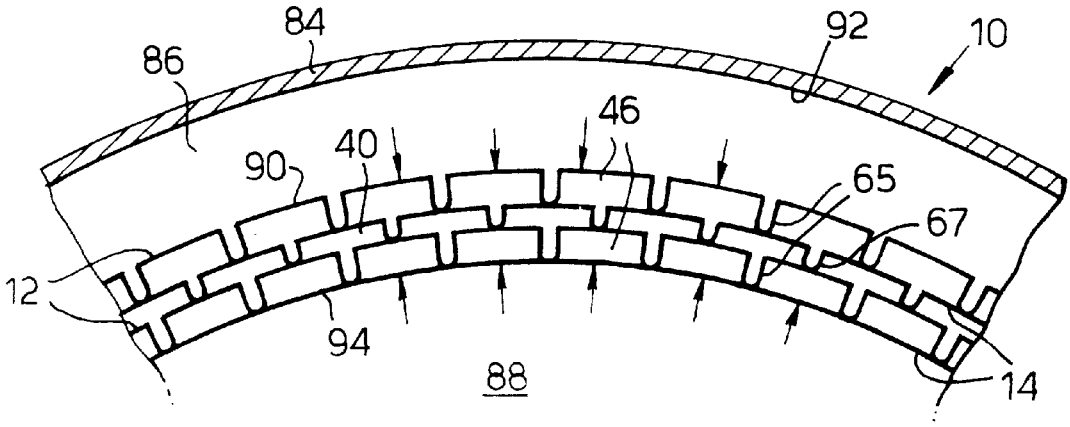
FIG. 11 is an enlarged view of part of the heat exchanger shown in FIG. 10.

Another heat exchanger suitable for a gas turbine engine intercooler, regenerator or recuperator, is shown in FIGS. 10 and 11. The heat exchanger 10 is similar to that shown in FIGS. 2 and 3 in that the heat exchanger 10 comprises a first continuous sheet of material 12 and a second continuous sheet of material 14 which are wound in a spiral. The first and second continuous sheets of material 12 and 14 have projections 65, 67 extending radially inwardly, or radially outwardly, to space apart adjacent turns of the first and second continuous sheets of material 12 and 14. A plurality of fluid flow passages are formed between the adjacent turns of the first and continuous sheets of material 12 and 14.

The heat exchanger 10 is positioned in the interior of a cylindrical pressure vessel 84. An annular space 86 is defined between an exterior surface 90 of the annular heat exchanger 10 and an interior surface 92 of the cylindrical pressure vessel 84, and a cylindrical space 88 is defined within the interior surface 94 of the heat exchanger 10. The annular space 86 and the cylindrical space 88 in the interior of the cylindrical pressure vessel 84 are connected via a pipe 96 to a source of high pressure fluid 98.

In operation high pressure fluid is supplied from the source of high pressure fluid 98 through pipe 96 to the annular space 86 and the cylindrical space 88 in the cylindrical pressure vessel 84. The high pressure fluid in the annular space 86 and the cylindrical space 88 completely surrounds the annular heat exchanger 10 and exerts a radial compressive load onto the annular heat exchanger 10. The radial compressive load on the annular heat exchanger 10 acts to compress the heat exchanger. The pressure loads produced by the high pressure fluid within the annular space 30 and the cylindrical space 32 are carried by the cylindrical pressure vessel 14 which carries the pressure loads in tension.

An advantage of the heat exchanger arrangement is that it is possible to operate the heat exchanger at higher pressures and at higher temperatures. Another advantage is that the annular heat exchanger has a safe failure mode. If the annular heat exchanger is over pressurised, or over heated, the annular heat exchanger buckles rather than bursts as do the prior art heat exchangers, and also the annular heat exchanger remains gas tight if over pressurised.

Figure 12:
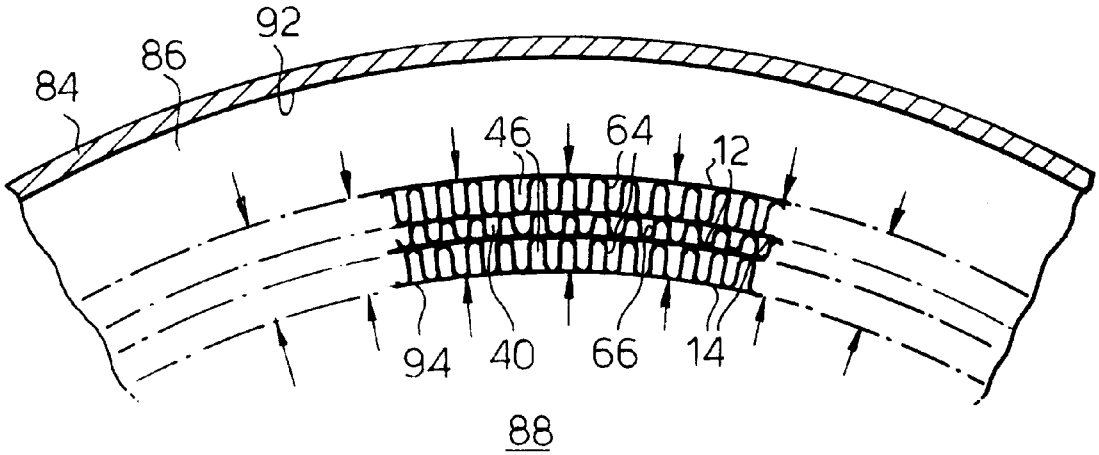
FIG. 12 is an enlarged alternative view of part of the heat exchanger shown in FIG. 10.

A further heat exchanger 10 suitable for a gas turbine engine intercooler, regenerator or recuperator is shown in FIGS. 10 and 12. The heat exchanger 10 is similar to that shown in FIGS. 5 and 6 in that the annular heat exchanger 12 is positioned in the interior of a cylindrical pressure vessel 84. The heat exchanger 10 comprises a first continuous sheet of material 12 and a second continuous sheet of material 14. Also a pair of continuous corrugated sheets of material 64 and 66 are positioned between the sheets of material 12 and 14.

The corrugated sheets of material 64 and 66 may be secured to the first and second continuous sheets of material 12 and 14 by a brazed, welded, or diffusion bonded joint. Alternatively and preferably the corrugated sheets of material 64 and 66 are not secured to the first and second continuous sheets of material 12 and 14.

An annular space 86 is defined between the exterior surface 90 of the annular heat exchanger 10 and the interior surface 92 of the cylindrical pressure vessel 84, and a cylindrical space 88 is defined within the interior surface 94 of the heat exchanger 10. The annular space 86 and the cylindrical space 88 in the interior of the cylindrical pressure vessel 84 are connected via a pipe 96 to a source of high pressure fluid 98.

In operation high pressure fluid is supplied from the source of high pressure fluid 98 through pipe 96 to the annular space 86 and the cylindrical space 88 in the cylindrical pressure vessel 84. The high pressure fluid in the annular space 86 and the cylindrical space 88 completely surrounds the annular heat exchanger 10 and exerts a radial compressive load onto the annular heat exchanger 10. The radial compressive load on the annular heat exchanger 10 acts to compress the corrugated sheets of material 64 and 66 radially and this feature makes it possible to make the annular heat exchanger 10 without securing the corrugated sheets of material 64 and 66 to the first and second continuous sheets of material 12 and 14. The pressure loads produced by the high pressure fluid within the annular space 86 and the cylindrical space 88 are carried by the cylindrical pressure vessel 84 which carries the pressure loads in tension.

The advantages of the heat exchanger arrangement is that it is possible to make the annular heat exchanger 10 without the need to secure, braze, the corrugated sheets of material 64 and 66 to the first and second continuous sheets of material 12 and 14. This allows the heat exchanger to be produced more quickly and with reduced expense. A further advantage is that it is possible to operate the heat exchanger at higher pressures and at higher temperatures. Another advantage is that the annular heat exchanger has a safe failure mode. If the annular heat exchanger is over pressurised, or over heated, the annular heat exchanger buckles rather than bursts as do the prior art heat exchangers, and also the annular heat exchanger remains gas tight if over pressurised.

Figure 13:
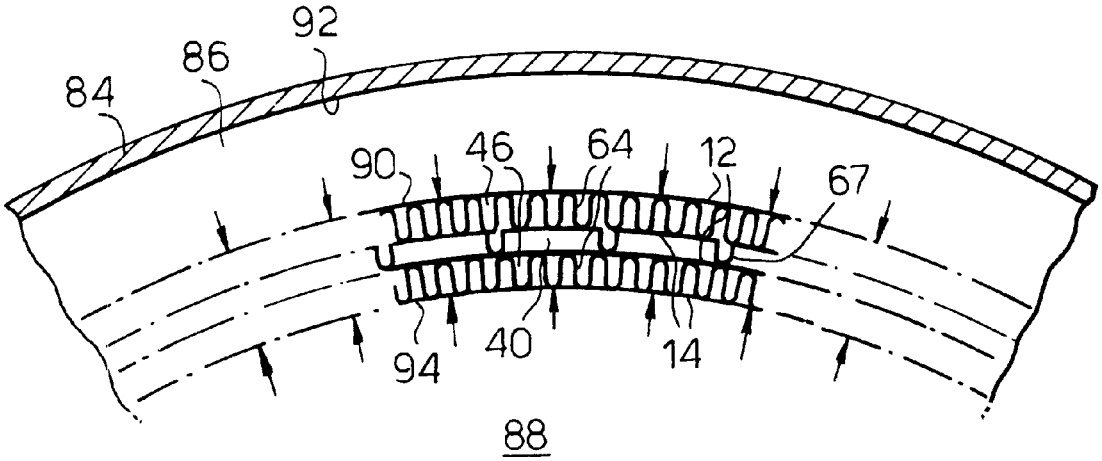
FIG. 13 is an enlarged alternative view of part of the heat exchanger shown in FIG. 10.

Another heat exchanger system 10 suitable for a gas turbine engine intercooler, regenerator or recuperator is shown in FIGS. 10 and 13. The heat exchanger 10 is similar to that shown in FIGS. 2, 8 and 9 in that the heat exchanger 12 comprises a first continuous sheet of material 12 and a second continuous sheet of material 14 which are wound in a spiral. The second continuous sheet of material 14 has projections 67 extending radially inwardly or radially outwardly to space them from the adjacent first continuous sheet of material 12. A corrugated sheet of material 64 is positioned between the adjacent first and second continuous sheets of material 12 and 14. The corrugated sheet of material 64 together with the first and second continuous sheets of material 12 and 14 define fluid flow passages. The first and second continuous sheets of material 12 and 14 have surfaces arranged to face each other and the projections 67 and the corrugated sheet of material 64 space the first and second continuous sheets of material 12 and 14 apart.

The corrugated sheet of material 64 may be secured to the first and second continuous sheets of material 12 and 14 by a plate 16 by a brazed, welded, or diffusion bonded joint. Alternatively and preferably the corrugated sheet of material 64 is not secured to the first and second continuous sheets of material 12 and 14.

An annular space 86 is defined between the exterior surface 90 of the annular heat exchanger 10 and the interior surface 92 of the cylindrical pressure vessel 84, and a cylindrical space 88 is defined within the interior surface 94 of the heat exchanger 10. The annular space 86 and the cylindrical space 88 in the interior of the cylindrical pressure vessel 84 are connected via a pipe 96 to a source of high pressure fluid 98.

The source of high pressure fluid may be a bottle of high pressure gas, for example a bottle of high pressure nitrogen etc, a source of compressed air, a source of pressurised liquid. In the case of a heat exchanger for a gas turbine engine it is possible to use the gas turbine engine as the source of the high pressure fluid, for example the compressor delivery air may be supplied to the interior of the pressure vessel. Also in the case of a heat exchanger for a gas turbine engine it is possible to use the compressor delivery air which is to be heated as the fluid to pressurise the interior of the pressure vessel. This may be achieved in FIG. 9 by providing apertures 42 through the heat exchanger 10 to interconnect with the annular chamber 86, but ensuring the apertures 44 do not interconnect with the annular chamber 86.

In an alternative arrangement, not shown, it may be possible to arrange for resilient material to be placed in the chambers around the heat exchanger. For example it may be possible to provide rubber, or other suitable material, within the chambers or to provide springs between the pressure vessel and the exterior surface of the heat exchanger.

As a further alternative it is possible to arrange at least one, preferably a plurality of, separate hoops around the heat exchanger to compressively load the heat exchanger. The hoops may provide the compressive load on the heat exchanger by providing a shrink fit, bolted joints or using low coefficient of thermal expansion material to form the hoops such that when the heat exchanger is heated it expands more than the hoops so that a compressive load is applied to the heat exchanger.

Although the invention has referred to and shown smoothly curved spiral heat exchangers which are substantially circular in cross-section, it is equally possible to achieve similar advantages using continuous sheets of metal wound around mandrels to form spiral heat exchangers which are square, rectangular, pentagonal, hexagonal, octagonal in cross-section.

We claim:

1. A method of manufacturing an annular heat exchanger comprising the steps of (a) forming a first continuous sheet of material having a first surface and a second surface, the first surface having longitudinally extending edges, (b) forming a second continuous sheet of material having a third surface and fourth surface, the third surface having longitudinally extending edges, (c) forming a first set of apertures in the first continuous sheet of material, forming a second set of apertures in the first continuous sheet of material, adjacent apertures in the first set of apertures being spaced apart longitudinally alone the first continuous sheet of material, adjacent apertures in the second set of apertures being spaced apart longitudinally along the first continuous sheet of material, the first and second set of apertures being spaced apart transversely over the first continuous sheet of material, (d) forming a third set of apertures in the second continuous sheet of material, forming a fourth set of apertures in the second continuous sheet of material, adjacent apertures in the third set of apertures being spaced apart longitudinally along the second continuous sheet of material, the third and fourth set of apertures being spaced apart transversely over the second continuous sheet of material, (e) winding the first and second continuous sheets of material together into a spiral such that the apertures of the first set of apertures in the first continuous sheet of material are aligned with the apertures in the third set of apertures in the second continuous sheet of material and the apertures of the second set of apertures in the first continuous sheet of material are aligned with the apertures of the fourth set of apertures in the second continuous sheet of material, (f) sealing the edges of the first surface of the first continuous sheet of material to the edges of the third surface of the second continuous sheet of material, (g) sealing the apertures of the first set of apertures in the first continuous sheet of material to the apertures in the third set of apertures in the second continuous sheet of material and sealing the apertures of the second set of apertures in the first continuous sheet of material to the apertures of the fourth set of apertures in the second continuous sheet of material, such that the second surface of the first continuous sheet of material is sealed to the fourth surface of the second continuous sheet of material.

2. A method as claimed in claim 1 including forming at least one continuous corrugated sheet of material, and winding the at least one continuous corrugated sheet of material together with the first and second continuous sheets of material.

3. A method as claimed in claim 2 including forming two continuous corrugated sheets of material, positioning one of the continuous corrugated sheets of material between the first and second continuous sheets of material and winding the continuous corrugated sheets of material together with the first and second continuous sheets of material.

4. A method as claimed in claim 1 wherein in step (f) the sealing of the edges is by welding, brazing or crimping.

5. A method as claimed in claim 4 wherein the sealing of at least one edge is by continuously welding in a spiral path.

6. A method as claimed 4 wherein the sealing of at least one edge is by continuously welding while the first and second continuous sheets of material are wound together in a spiral.

7. A method as claimed in claim 4 wherein the sealing of at least one edge is by continuously welding in a spiral path after the first and second continuous sheets of material have been wound together into a spiral.

8. A method as claimed in claim 1 wherein in step (g) the sealing of the apertures is by welding, brazing or crimping.

9. A method as claimed in claim 1 wherein the sealing of the apertures in step (g) is performed before step (e).

10. A method as claimed in claim 1 wherein depressions are formed around the first set of apertures and second set of apertures in the first continuous sheet of material, the depressions extend towards the fourth surface of the second continuous sheet of material.

11. A method as claimed in claim 10 wherein depressions are formed around the third set of apertures and fourth set of apertures in the second continuous sheet of material, the depressions extend towards the second surface of the first continuous sheet of material.

12. A method as claimed in claim 1 wherein the edges of the first surface of the first continuous sheet of material are deformed towards the third surface of the second continuous sheet of material.

13. A method as claimed in claim 12 wherein the edges of the third surface of the second continuous sheet of material are deformed towards the first surface of the second continuous sheet of material.

14. A method as claimed in claim 1 wherein in step (e) the first and second continuous sheets of material are wound around a mandrel.

* * * * *